US010612552B2

(12) United States Patent
Varland

(10) Patent No.: US 10,612,552 B2
(45) Date of Patent: Apr. 7, 2020

(54) BEARING FREE AXIAL FAN

(71) Applicant: HAMILTON SUNDSTRAND CORPORATION, Windsor Locks, CT (US)

(72) Inventor: Eric O. Varland, Rockford, IL (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 281 days.

(21) Appl. No.: 15/059,950

(22) Filed: Mar. 3, 2016

(65) Prior Publication Data

US 2017/0254335 A1 Sep. 7, 2017

(51) Int. Cl.
*F04D 25/02* (2006.01)
*F04D 19/00* (2006.01)
(Continued)

(52) U.S. Cl.
CPC ..... *F04D 25/026* (2013.01); *F04D 19/002* (2013.01); *F04D 19/005* (2013.01);
(Continued)

(58) Field of Classification Search
CPC ..... F04D 25/08; F04D 25/026; F04D 29/048; F04D 29/0606; F04D 29/325; F04D 29/526; H02K 1/272; H02K 1/2726; H02K 1/274
See application file for complete search history.

(56) References Cited

U.S. PATENT DOCUMENTS 3,034,762 A * 5/1962 Fanti ..... F01D 5/225 415/119
5,075,606 A 12/1991 Lipman
(Continued)

FOREIGN PATENT DOCUMENTS

DE 102008049757 A1 4/2010
EP 2853750 A1 * 4/2015 ..... F04D 25/066
(Continued)

OTHER PUBLICATIONS

Extended European Search Report for EP Application No. 17158991.4; dated Jul. 28, 2017 (7 pages).
(Continued)

*Primary Examiner* — Kenneth J Hansen
(74) *Attorney, Agent, or Firm* — Cantor Colburn LLP

(57) ABSTRACT

An axial fan includes a rotatable fan blade assembly including a plurality of fan blades, and a plurality of permanent magnets affixed to the plurality of fan blades. A stationary guide channel is located radially outboard of the fan blade assembly. A plurality of field coils are located at the guide channel and are configured to drive rotation of the fan blade assembly via magnetic interaction with the plurality of permanent magnets when the plurality of field coils are sequentially energized. A method of operating an axial fan includes energizing a plurality of field coils, urging a fan blade assembly out of contact with the guide channel via magnetic interaction between the plurality of field coils and a plurality of permanent magnets located at the fan blade assembly, and sequentially pulsing the plurality of field coils thereby urging rotation of the fan blade assembly about an axis of rotation.

17 Claims, 2 Drawing Sheets

(51) Int. Cl.
*F04D 25/08* (2006.01)
*F04D 29/32* (2006.01)
*F04D 29/52* (2006.01)

(52) U.S. Cl.
CPC ..... *F04D 25/08* (2013.01); *F04D 29/325* (2013.01); *F04D 29/526* (2013.01)

(56) References Cited

U.S. PATENT DOCUMENTS

| | | | | |
|---|---|---|---|---|
| 7,410,123 | B2 | 8/2008 | Nunnally | |
| 2011/0210690 | A1* | 9/2011 | Vogel ..... | H02K 41/031<br>318/631 |
| 2015/0226086 | A1 | 8/2015 | Samuelson | |

FOREIGN PATENT DOCUMENTS

| | | | |
|---|---|---|---|
| GB | 2370922 | A | 7/2002 |
| NL | 9401288 | A | 3/1996 |
| WO | 2015005776 | A1 | 1/2015 |

OTHER PUBLICATIONS

German Patent No. 102008049757; Date of Publication: Apr. 1, 2010; English Abstract, 1 page.

* cited by examiner

BEARING FREE AXIAL FAN

BACKGROUND

The subject matter disclosed herein relates to axial fans. More specifically, the present disclosure relates to drive and support of axial fans.

Many systems, such as air handlers and heating, ventilation, air conditioning and refrigeration (HVAC&R) systems utilize axial fans to drive airflow through the system, for example to drive airflow across heat exchangers of an HVAC&R system. The axial fan typically includes a plurality of fan blades extending radially outwardly from a central axis, with the fan blades being connected to a central shaft at the central axis. Rotation of the central shaft drives rotation of the plurality of fan blades, which in turn induces the airflow. The axial fan may also include a shroud located radially outboard of the plurality of fan blades to direct the airflow in a desired direction.

The central shaft is typically driven by a motor, such as an electric motor, located at or near the central axis, and a bearing arrangement is located at the central shaft to support the central shaft and the plurality of fan blades at the motor, while allowing rotation of the central shaft and the plurality of fan blades about the central axis. The motor and the bearing arrangement and associated wiring and other components are located in the fan flowpath and partially obscure airflow therethrough. Further, the bearing arrangement often requires maintenance or repair and is a common source of axial fan failure. Also, due to air borne dust particles the motor can become clogged with dust causing overheating issues.

SUMMARY

In one embodiment, an axial fan includes a rotatable fan blade assembly including a plurality of fan blades, and a plurality of permanent magnets affixed to the plurality of fan blades. A stationary guide channel is located radially outboard of the fan blade assembly. A plurality of field coils are located at the guide channel and are configured to drive rotation of the fan blade assembly via magnetic interaction with the plurality of permanent magnets when the plurality of field coils are sequentially energized.

Additionally or alternatively, in this or other embodiments the plurality of fan blades extend from a center hub to an outer ring.

Additionally or alternatively, in this or other embodiments the plurality of permanent magnets are disposed at the outer ring.

Additionally or alternatively, in this or other embodiments the guide channel has a U-shaped cross-section, with the fan blade assembly disposed inside of the U-shaped cross-section.

Additionally or alternatively, in this or other embodiments the guide channel contains the fan blade assembly and/or prevents wobble of the fan blade assembly during operation of the axial fan.

Additionally or alternatively, in this or other embodiments the plurality of field coils are operably connected to a power source located radially outboard of the guide channel.

Additionally or alternatively, in this or other embodiments the axial fan is configured such that when the plurality of field coils are energized the fan blade assembly is radially spaced from the guide channel around an entire circumference of the fan blade assembly, and when the plurality of field coils are deenergized the fan blade assembly is in radial contact with the guide channel at at least one location around the circumference of the fan blade assembly.

Additionally or alternatively, in this or other embodiments one or more of the guide channel and the fan blade assembly has a low friction material applied thereto to reduce friction between the guide channel and the fan blade assembly.

In another embodiment, a method of operating an axial fan includes energizing a plurality of field coils positioned at a guide channel of the axial fan, urging a fan blade assembly out of contact with the guide channel via magnetic interaction between the plurality of field coils and a plurality of permanent magnets located at the fan blade assembly, and sequentially pulsing the plurality of field coils thereby urging rotation of the fan blade assembly about an axis of rotation by magnetic interaction between the plurality of permanent magnets and the sequentially pulsed plurality of field coils.

Additionally or alternatively, in this or other embodiments the pulsation of the plurality of field coils is varied, thereby changing a rotational speed of the fan blade assembly.

Additionally or alternatively, in this or other embodiments the plurality of field coils is deenergized to stop rotation of the fan blade assembly.

Additionally or alternatively, in this or other embodiments the plurality of fan blades extend from a center hub to an outer ring.

Additionally or alternatively, in this or other embodiments the plurality of permanent magnets are located at the outer ring.

Additionally or alternatively, in this or other embodiments the guide channel has a U-shaped cross-section, with the fan blade assembly located inside of the U-shaped cross-section.

Additionally or alternatively, in this or other embodiments the guide channel contains the fan blade assembly and/or prevents wobble of the fan blade assembly during operation of the axial fan.

In yet another embodiment, an axial fan includes a fan blade assembly rotatable about an axis of rotation and including a plurality of fan blades and a plurality of permanent magnets. A plurality of field coils are located radially outboard of the fan blade assembly. The plurality of field coils are configured to both radially support the fan blade assembly and drive rotation of the fan blade assembly about the axis of rotation via magnetic interaction between the plurality of field coils and the plurality of permanent magnets.

Additionally or alternatively, in this or other embodiments a guide channel is positioned radially outboard of the fan blade assembly and is aligned and configured to prevent wobble of the fan blade assembly during operation of the axial fan.

Additionally or alternatively, in this or other embodiments the guide channel has a U-shaped cross-section, with the fan blade assembly located inside of the U-shaped cross-section.

Additionally or alternatively, in this or other embodiments the axial fan is configured such that when the plurality of field coils are energized the fan blade assembly is radially spaced from the guide channel around an entire circumference of the fan blade assembly, and when the plurality of field coils are deenergized the fan blade assembly is in radial contact with the guide channel at at least one location around the circumference of the fan blade assembly.

Additionally or alternatively, in this or other embodiments the plurality of fan blades extend from a center hub to an outer ring, the plurality of permanent magnets located at the outer ring.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
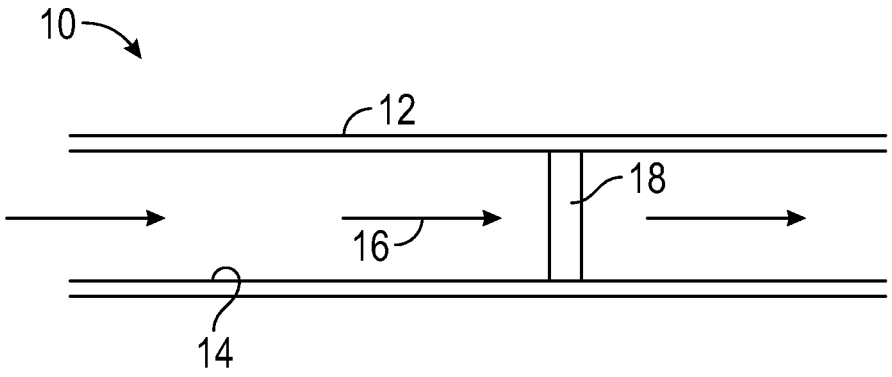
FIG. 1 is a schematic view of an embodiment of an air handling system.

Referring now to FIG. 1, an exemplary embodiment of an air handling system 10 for, for example, an aircraft cabin is shown. The air handling system 10 includes an airflow duct 12 and may have one or more dampers 14 to selectably restrict airflow 16 through the airflow duct 12. The air handling system 10 further includes an axial fan 18 to urge the airflow 16 through the airflow duct 12.

Figure 2:
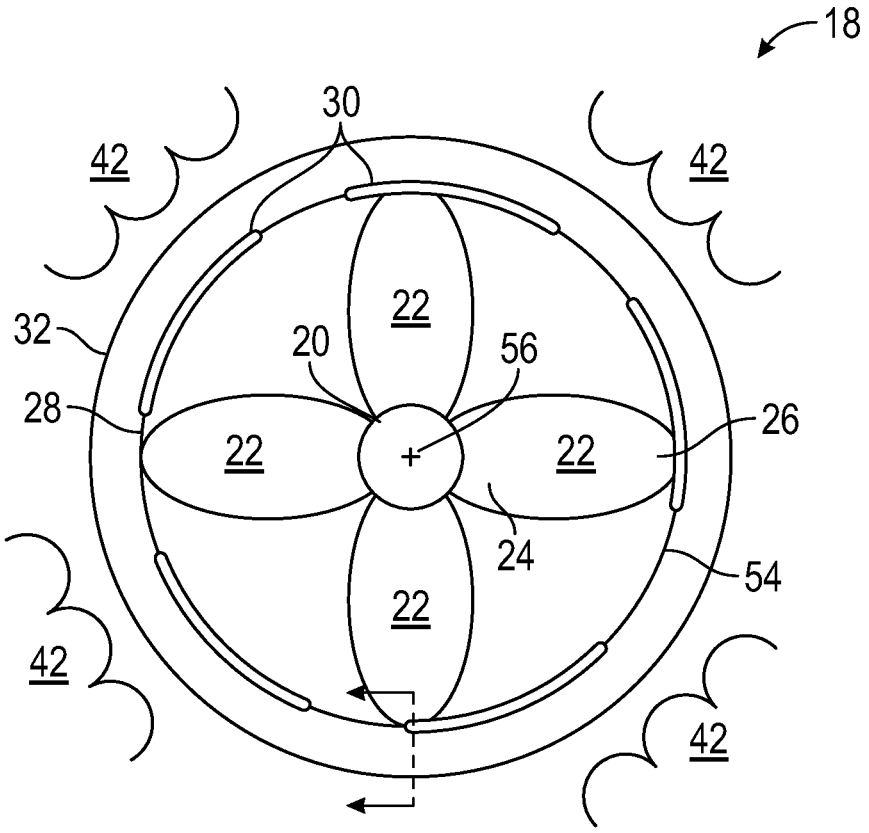
FIG. 2 is a plan view of an embodiment of an axial fan.

Referring now to FIG. 2, the axial fan 18 includes a rotating fan blade assembly 54. The fan blade assembly 54 includes an inner hub 20, with a plurality of fan blades 22 attached to the inner hub 20 at a blade root 24 of each fan blade 22. The fan blades 22 extend radially outwardly from the inner hub 20 to a blade tip 26. The fan blades 22 are secured to an outer ring 28 at the blade tip 26 of each fan blade 22. The fan blades 22 are secured to the inner hub 20 and to the outer ring 28 to maintain orientation of the fan blades 22, such as blade spacing, blade pitch angle and blade profile. The outer ring 28 includes a plurality of permanent magnets 30 secured to the outer ring 28 and arrayed around a circumference of the outer ring 28. The permanent magnets 30 may be equally spaced around the circumference of the outer ring 28. In some embodiments, five (5) permanent magnets 30 are secured to the outer ring 28, but it is to be appreciated that other quantities of permanent magnets 30 may be utilized to meet fan 18 operational requirements.

Figure 3:
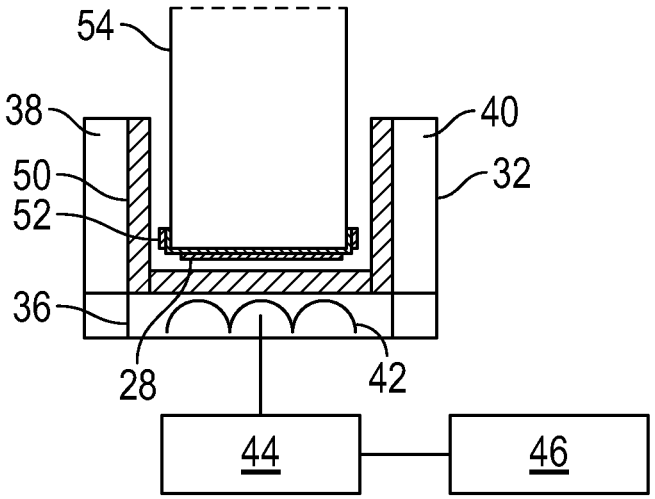
FIG. 3 is a partial cross-sectional view of an embodiment of an axial fan.
Figure 4:
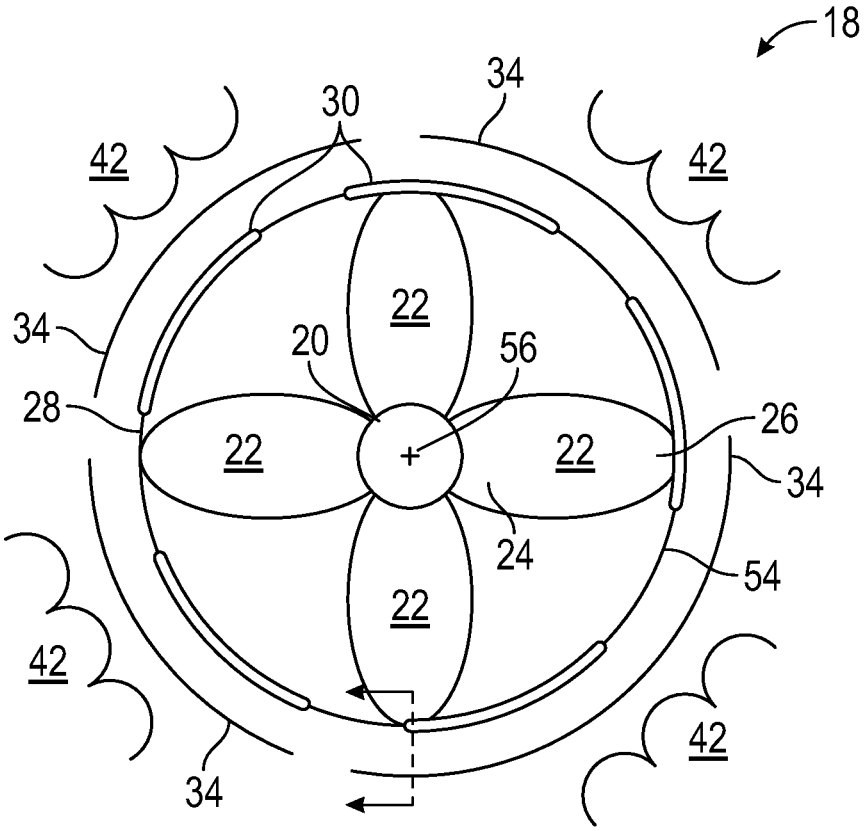
FIG. 4 is a plan view of another embodiment of an axial fan.

Referring now to FIG. 3, fan blade assembly 54 is positioned in a stationary guide channel 32 extending around the outer circumference of the outer ring 28. The guide channel 32 may extend around the entire circumference as shown in FIG. 2, or may alternatively be a plurality of guide channel segments 34 each extending partially around the circumference as shown in FIG. 4. Referring again to FIG. 2, the guide channel 32 includes an outboard portion 36, a first axial portion 38 and a second axial portion 40. Together, the outboard portion 36, the first axial portion 38 and the second axial portion 40 from a U-shaped guide channel 32 extending around the outer circumference of the outer ring 28, with the outer ring 28 located inside of the guide channel 32. In some embodiments, the guide channel 32 is an integral portion of the airflow duct 12, while in other embodiments the guide channel 32 is a separate component secured in the airflow duct 12. The guide channel 32 may include a protective lining 50 at an interior of the guide channel 32 between the guide channel 32 wall and the outer ring 28 and/or the fan blades 22. Further, one or more ring guides 52 may be secured to the outer ring 28. The ring guides 52 and the protective lining 50 may be formed from a low friction material, such as a low friction polymer. The guide channel 32 is configured to contain the fan blade assembly 54 during system upsets, such as a large object in the air stream striking the fan blade assembly 54.

A plurality of field coils 42 are located at the guide channel 32 and are operably connected to a power source 46 and fan controller 44. Since the power source 46 and the fan controller 44 are utilized to supply electrical power to the fired coils 42, the power source 46 and the fan controller 44, along with the associated wiring are positioned outside of the guide channel 32 and not across a flowpath of the axial fan 18 and thus do not impede the airflow 16 through the axial fan 18. The field coils 42 are interactive with the permanent magnets 30 such that when the field coils 42 are energized, the fan blade assembly 54 is suspended in the guide channel 32 with an air gap 48 between the outer ring 28 and the guide channel 32. Once the fan blade assembly 54 is suspended in the guide channel 32, the field coils 42 are sequentially pulsed by the fan controller 44 to drive rotation of the fan blade assembly 54 about a fan rotational axis 56. The rotation of the fan blade assembly 54 about the fan rotational axis 56 is caused by the varying attraction between the permanent magnets 30 at the outer ring 28 and the sequentially pulsed field coils 42.

During normal operation, the fan blade assembly 54 floats within the guide channel 32, with the ring guides 42 and the protective lining 50 acting as buffers in the case of incidental contact between the guide channel 32 and the outer ring 28. The field coils 42 are also utilized to stop the fan blade assembly 54. To do so, the sequenced pulsing of the field coils 42 is stopped to stop rotation of the fan blade assembly 54. Once the rotation of the fan blade assembly 54 is stopped, the field coils 42 may be deenergized, so that the fan blade assembly 54 comes to rest in the guide channel 32. As one skilled in the art will readily appreciate, speed of rotation of the fan blade assembly 54 about the fan rotational axis 56 may be varied by varying the sequential pulsing of the field coils 42. Similarly, the direction of rotation of the fan blade assembly 54 about the fan rotational axis 56 is changeable by changing the sequential pulsing of the field coils 42.

The axial fan 18 disclosed herein is operable without a traditional bearing assembly located at the fan rotational axis and further the power source 46 and fan controller 44 are located outside of the fan flowpath. Eliminating the bearing and moving the other components outside of the flowpath reduces obstruction of the flowpath and also reduces maintenance needs of the axial fan 18, since the traditional bearing is eliminated. Also, the axial fan 18 removes the traditional electric motor and associated wiring from the air stream thus reducing air flow restrictions. The axial fan 18 eliminates the need to remove and clean the motor of any dust particles that will accumulate in and on the motor.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An axial fan, comprising:

a rotatable fan blade assembly including a plurality of fan blades extending from a center hub to an outer ring;

a plurality of permanent magnets affixed to the plurality of fan blades;

a stationary guide channel disposed radially outboard of the fan blade assembly, the stationary guide channel including a plurality of guide channel segments having a circumferential gap between adjacent guide channel segments of the plurality of guide channel segments, the stationary guide channel extending around an outer circumference of the outer ring and including:

a first axial portion disposed at and axially spaced from a first axial side of the fan blade assembly;

a second axial portion disposed at and axially spaced from a second axial side of the fan blade assembly, opposite the first axial side; and an outboard portion connecting the first axial portion to the second axial portion;

wherein the outer ring is located inside the guide channel;

a plurality of field coils located at the guide channel, the plurality of field coils configured to drive rotation of the fan blade assembly via magnetic interaction with the plurality of permanent magnets when the plurality of field coils are sequentially energized; and one or more ring guides disposed at the outer ring, the one or more ring guides extending axially beyond an axial extent of the plurality of fan blades to prevent contact of the plurality of fan blades to the stationary guide channel.

2. The axial fan of claim 1, wherein the plurality of permanent magnets are disposed at the outer ring.

3. The axial fan of claim 1, wherein the guide channel has a U-shaped cross-section, with the fan blade assembly disposed inside of the U-shaped cross-section.

4. The axial fan of claim 1, wherein the guide channel contains the fan blade assembly and/or prevents wobble of the fan blade assembly during operation of the axial fan.

5. The axial fan of claim 1, wherein the plurality of field coils are operably connected to a power source located radially outboard of the guide channel.

6. The axial fan of claim 1, wherein the axial fan is configured such that when the plurality of field coils are energized the fan blade assembly is radially spaced from the guide channel around an entire circumference of the fan blade assembly, and when the plurality of field coils are deenergized the fan blade assembly is in radial contact with the guide channel at at least one location around the circumference of the fan blade assembly.

7. The axial fan of claim 1, wherein one or more of the guide channel and the fan blade assembly has a low friction material applied thereto to reduce friction between the guide channel and the fan blade assembly.

8. A method of operating an axial fan comprising:

energizing a plurality of field coils disposed at a guide channel of the axial fan, the guide channel including a plurality of guide channel segments having a circumferential gap between adjacent guide channel segments of the plurality of guide channel segments;

urging a fan blade assembly out of contact with the guide channel via magnetic interaction between the plurality of field coils and a plurality of permanent magnets disposed at the fan blade assembly, the fan blade assembly including a plurality of fan blades extending from a center hub to an outer ring;

sequentially pulsing the plurality of field coils thereby urging rotation of the fan blade assembly about an axis of rotation by magnetic interaction between the plurality of permanent magnets and the sequentially pulsed plurality of field coils; and preventing contact between the plurality of fan blades and the guide channel via one or more ring guides disposed at the outer ring, the one or more ring guides extending axially beyond an axial extent of the plurality of fan blades, the guide channel extending around an outer circumference of the outer ring and including:

a first axial portion disposed at and axially spaced from a first axial side of the fan blade assembly;

a second axial portion disposed at and axially spaced from a second axial side of the fan blade assembly, opposite the first axial side; and an outboard portion connecting the first axial portion to the second axial portion wherein the outer ring is located inside the guide channel.

9. The method of claim 8, further comprising varying the pulsation of the plurality of field coils, thereby changing a rotational speed of the fan blade assembly.

10. The method of claim 8, further comprising deenergizing the plurality of field coils to stop rotation of the fan blade assembly.

11. The method of claim 8, wherein the plurality of permanent magnets are disposed at the outer ring.

12. The method of claim 8, wherein the guide channel has a U-shaped cross-section, with the fan blade assembly disposed inside of the U-shaped cross-section.

13. The method of claim 8, wherein the guide channel contains the fan blade assembly and/or prevents wobble of the fan blade assembly during operation of the axial fan.

14. An axial fan comprising:

a fan blade assembly rotatable about an axis of rotation and including:

a plurality of fan blades extending from a center hub to an outer ring; and a plurality of permanent magnets;

a plurality of field coils disposed radially outboard of the fan blade assembly, the plurality of field coils configured to both radially support the fan blade assembly and drive rotation of the fan blade assembly about the axis of rotation via magnetic interaction between the plurality of field coils and the plurality of permanent magnets; and one or more ring guides disposed at the outer ring, the one or more ring guides extending axially beyond an axial extent of the plurality of fan blades to prevent contact of the plurality of fan blades to a stationary guide channel, the stationary guide channel extending around an outer circumference of the outer ring and including:

a first axial portion disposed at and axially spaced from a first axial side of the fan blade assembly;

a second axial portion disposed at and axially spaced from a second axial side of the fan blade assembly, opposite the first axial side; and an outboard portion connecting the first axial portion to the second axial portion wherein the outer ring is located inside the guide channel;

the stationary guide channel including a plurality of guide channel segments having a circumferential gap between adjacent guide channel segments of the plurality of guide channel segments.

15. The axial fan of claim 14, wherein the guide channel has a U-shaped cross-section, with the fan blade assembly disposed inside of the U-shaped cross-section.

16. The axial fan of claim 14, wherein the axial fan is configured such that when the plurality of field coils are energized the fan blade assembly is radially spaced from the guide channel around an entire circumference of the fan blade assembly, and when the plurality of field coils are deenergized the fan blade assembly is in radial contact with the guide channel at at least one location around the circumference of the fan blade assembly.

17. The axial fan of claim 14, wherein the plurality of permanent magnets are disposed at the outer ring.

* * * * *